US011143154B2

(12) United States Patent
Masti

(10) Patent No.: US 11,143,154 B2
(45) Date of Patent: Oct. 12, 2021

(54) FUEL SYSTEM HAVING A CONNECTION BETWEEN A FUEL INJECTOR AND A FUEL DISTRIBUTION CONDUIT

(71) Applicant: DELPHI TECHNOLOGIES IP LIMITED, St. Michael (BB)

(72) Inventor: Ravish S. Masti, Karnataka (IN)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/817,688

(22) Filed: Mar. 13, 2020

(65) Prior Publication Data

US 2021/0285413 A1 Sep. 16, 2021

(51) Int. Cl.

| | |
|---|---|
| ***F02M 69/46*** | (2006.01) |
| ***F02M 61/14*** | (2006.01) |
| ***F02M 55/00*** | (2006.01) |
| ***F02M 61/10*** | (2006.01) |

(52) U.S. Cl.

CPC ..... *F02M 69/462* (2013.01); *F02M 55/005* (2013.01); *F02M 61/10* (2013.01); *F02M 61/14* (2013.01); *F02M 2200/856* (2013.01)

(58) Field of Classification Search

CPC ..... F02M 61/14; F02M 61/168; F02M 2200/858; F02M 55/02; F02M 55/005; F02M 39/00; F02M 55/025; F02M 2200/856; F02M 63/028; F02M 2200/16; F16L 19/0212

See application file for complete search history.

(56) References Cited

U.S. PATENT DOCUMENTS

| | | | | |
|---|---|---|---|---|
| 4,832,376 A * | 5/1989 | Sugao | F16L 41/12 285/141.1 |
| 5,667,255 A * | 9/1997 | Kato | F02M 55/005 285/133.4 |
| 7,568,736 B2 * | 8/2009 | Asada | F02M 55/005 285/125.1 |
| 8,186,724 B2 * | 5/2012 | Kato | F02M 55/02 285/386 |
| 8,196,967 B2 * | 6/2012 | Seifert | F16L 19/025 285/14 |
| 8,640,673 B2 | 2/2014 | Male | |

(Continued)

FOREIGN PATENT DOCUMENTS

CN 102705605 A 10/2012

*Primary Examiner* — Sizo B Vilakazi
(74) *Attorney, Agent, or Firm* — Joshua M. Haines

(57) ABSTRACT

A fuel system includes a fuel injector having an inlet conduit which extends along an inlet conduit axis and has an inlet conduit shoulder which is traverse to the inlet conduit axis. A fuel distribution conduit supplies fuel to the fuel injector, extends along a fuel distribution conduit axis, and has external threads which threadably engage internal threads of a connection nut. The connection nut has an internal shoulder which is traverse to the fuel distribution conduit axis. A retention member is a segment of an annulus and includes a central passage extending axially therethrough. The retention member is terminated in a direction circumferentially about the fuel distribution conduit axis by first and second end surfaces which together form a retention member slot therebetween sized to permit the inlet conduit to pass therethrough in a direction perpendicular to the fuel distribution conduit axis.

15 Claims, 10 Drawing Sheets

(56) References Cited

U.S. PATENT DOCUMENTS

| | | | | |
|---|---|---|---|---|
| 10,801,457 | B1 * | 10/2020 | Masti | F02M 55/025 |
| 2005/0284447 | A1 | 12/2005 | Usui et al. | |
| 2008/0042434 | A1 | 2/2008 | Kenny | |
| 2010/0123029 | A1 * | 5/2010 | Hornby | F02M 51/0603 239/584 |
| 2014/0366351 | A1 * | 12/2014 | Whitaker | F02M 61/14 29/264 |
| 2016/0102641 | A1 | 4/2016 | Harter | |
| 2017/0350358 | A1 | 12/2017 | Bayer et al. | |
| 2018/0094614 | A1 | 4/2018 | Tadokoro et al. | |

* cited by examiner

FUEL SYSTEM HAVING A CONNECTION BETWEEN A FUEL INJECTOR AND A FUEL DISTRIBUTION CONDUIT

TECHNICAL FIELD OF INVENTION

The present disclosure relates to a fuel system; more particularly to such a fuel system which includes a fuel injector and a fuel distribution conduit; and even more particularly to such a fuel system which provides a fuel-tight connection between the fuel injector and the fuel distribution conduit.

BACKGROUND OF INVENTION

Fuel injection systems that deliver fuel to fuel consuming devices, for example internal combustion engines, have been known for many years. In modern internal combustion engines, it is increasingly common to provide fuel injectors which inject fuel, for example gasoline, directly into combustion chambers of the internal combustion engine. These internal combustion engines commonly include multiple combustion chambers, and consequently, each combustion chamber is provided with a respective fuel injector to inject fuel therein. A common conduit, typically referred to as a fuel rail, includes an inlet which receives fuel from a fuel source, such as one or more fuel pumps, and also includes a plurality of outlets, each of which is connected to a respective one of the fuel injectors.

Fuel injectors in gasoline fuel injection systems currently are predominantly sealed to a fuel distribution conduit, which supplies fuel to the fuel injector from the fuel rail, by an O-ring which is made of an elastomeric material. One such arrangement which uses an elastomeric O-ring is shown in United States Patent Application Publication No. US 2017/0350358 to Bayer et al. While O-rings may be adequate for sealing in current systems which operate below 35 MPa, in order to meet more stringent emissions requirements and fuel economy demands, gasoline fuel injection systems are expected to exceed 35 MPa and will likely exceed 50 MPa. Sealing with an elastomeric O-ring in systems using these elevated pressures may be difficult. Consequently, metal-to-metal sealing arrangements are being explored to provide robust sealing between the fuel injector and the fuel supply conduit. Many metal-to-metal sealing arrangements are known for joining a first metal conduit to a second metal conduit. Such arrangements may include an external thread formed on the first metal conduit while the second metal conduit includes a radially enlarged region which is used to engage a connection nut having internal threads. Consequently, when the connection nut is tightened, force from the connection nut is transferred through the radially enlarged region of the second metal conduit, thereby causing complementary sealing surfaces of the first metal conduit and the second metal conduit to be sealingly compressed against each other. One such arrangement is shown in United States Patent Application Publication No. US 2008/0042434 A1 to Kenny. However, such arrangements require the radially enlarged region to be formed after the nut has been applied to second metal conduit. This may be accomplished by deformation of the second metal conduit or by fixing another component to the second metal conduit. While this may be practical when the second metal conduit is thin-walled tubing, this approach may not be practical when the second metal conduit is integrally formed with the fuel rail, for example in a casting or forging operation or is integrally formed with the fuel injector since deformation may result in damage to sensitive internal components or may alter fuel spray characteristics of the fuel injector. Furthermore, arrangements such as those disclosed by Kenny may require multiple interfaces to be sealed which results in a higher risk of fuel leakage.

What is needed is an arrangement for joining a fuel injector to a fuel distribution conduit which minimizes or eliminates one or more of the shortcomings set forth above.

SUMMARY OF THE INVENTION

Briefly described, a fuel system is provided for supplying fuel to a fuel consuming device. The fuel system includes a fuel injector having a fuel injector inlet conduit, a nozzle opening, and a valve needle which is moveable to selectively permit and prevent flow of fuel from the fuel injector inlet conduit through the nozzle opening, the fuel injector inlet conduit extending along a fuel injector inlet conduit axis and the fuel injector inlet conduit having a fuel injector inlet conduit shoulder which is traverse to the fuel injector inlet conduit axis; a fuel distribution conduit which supplies fuel to the fuel injector, the fuel distribution conduit extending along a fuel distribution conduit axis and having external threads thereon; a connection nut having internal threads which are complementary to, and threadably engaged with, the external threads of the fuel distribution conduit, the connection nut also having a connection nut internal shoulder which is traverse to the fuel distribution conduit axis; and a retention member which is a segment of an annulus and which includes a central passage extending axially therethrough, the retention member being terminated in a direction circumferentially about the fuel distribution conduit axis by a first end surface and by a second end surface which together form a retention member slot therebetween which is sized so as to permit the fuel injector inlet conduit to pass therethrough in a direction perpendicular to the fuel distribution conduit axis, and wherein the retention member engages the fuel injector inlet conduit shoulder and the connection nut internal shoulder such that tightening of the connection nut causes the retention member to be compressed between the fuel injector inlet conduit shoulder and the connection nut internal shoulder and also results in a fuel-tight connection between the fuel injector and the fuel distribution conduit. The fuel system described herein provides for robust sealing at ever-increasing pressures while providing simple construction. The fuel system described herein may also allow for minimal design change to existing fuel injector designs, which had previously used convention elastomer O-rings to achieve sealing, to be changed to a metal-to-metal sealing interface. Such design change may be limited to altering the outer profile of the fuel injector inlet conduit. Consequently, minimal manufacturing equipment change may be required to change the fuel injector design to accommodate a metal-to-metal sealing interface.

BRIEF DESCRIPTION OF DRAWINGS

This invention will be further described with reference to the accompanying drawings in which.

DETAILED DESCRIPTION OF INVENTION

Figure 1:
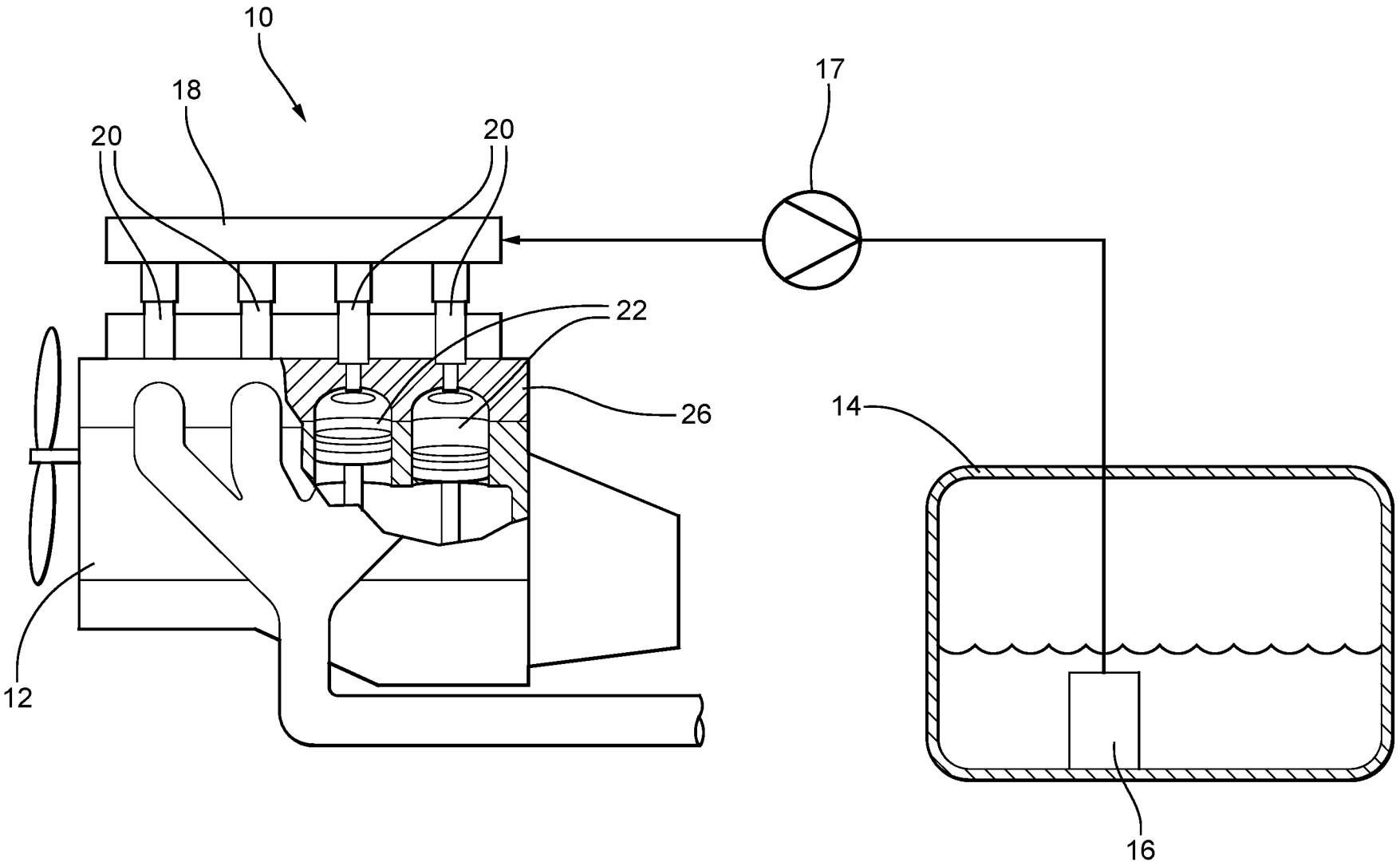
FIG. 1 is a schematic view of a fuel system in accordance with the present disclosure.
Figure 2:
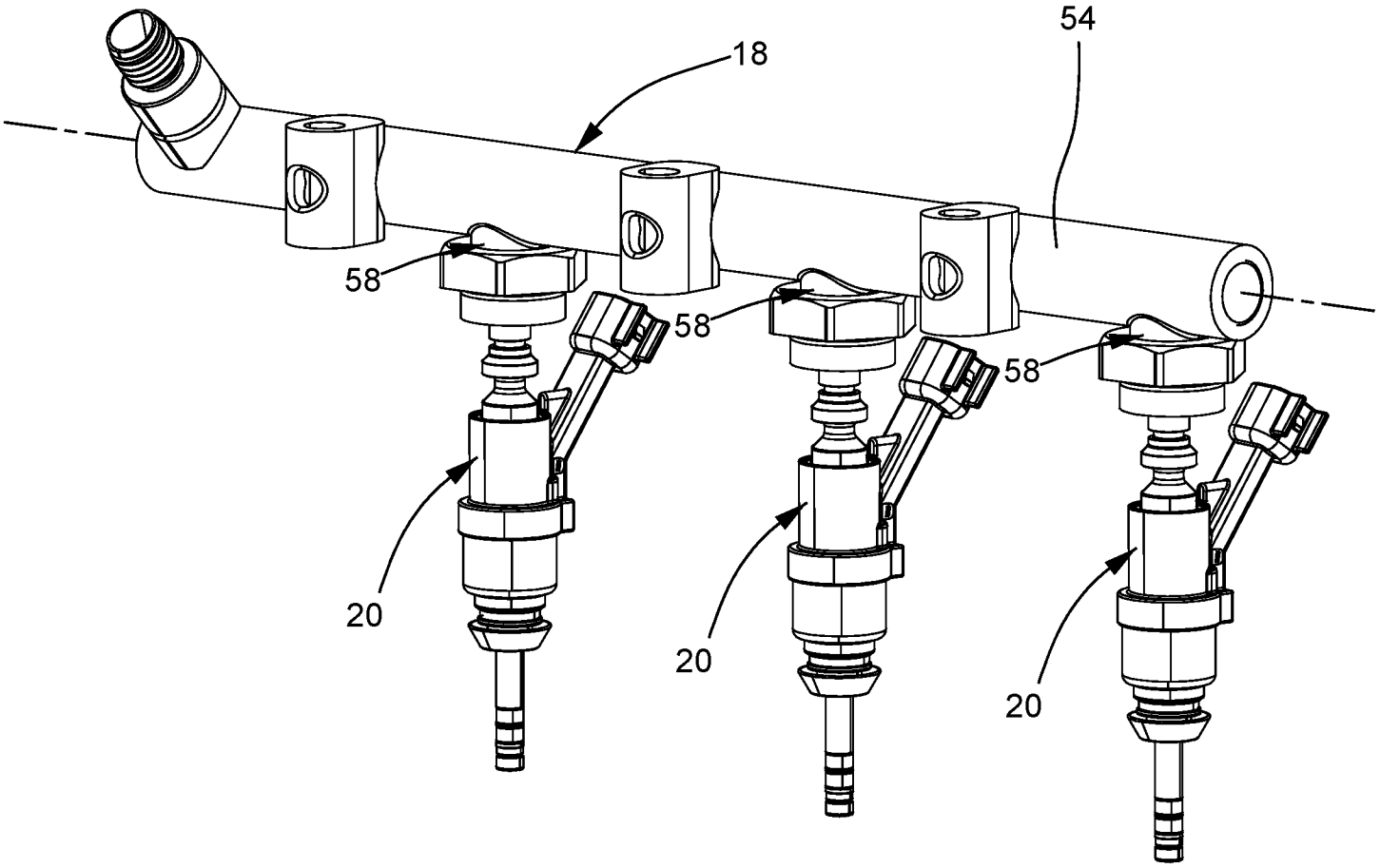
FIG. 2 is an isometric view of a fuel rail with fuel injectors in accordance with the present disclosure.

Referring initially to FIG. 1, a fuel system 10 is shown in simplified schematic form for supplying fuel to a fuel consuming device, for example an internal combustion engine 12, by way of non-limiting example only, for a motor vehicle. Fuel system 10 includes a fuel tank 14 for storing a volume of fuel, a low-pressure fuel pump 16 which may be located within fuel tank 14 as shown, a high-pressure fuel pump 17 which receives fuel from low-pressure fuel pump 16, a fuel rail 18 attached to internal combustion engine 12 and in fluid communication with high-pressure fuel pump 17, and a plurality of fuel injectors 20 in fluid communication with fuel rail 18. In operation, low-pressure fuel pump 16 draws fuel from fuel tank 14 and pumps the fuel to high-pressure fuel pump 17 under relatively low pressure, for example about 500 kPa. High-pressure fuel pump 17, which may be a piston pump operated by a cam of internal combustion engine 12, further pressurizes the fuel and supplies the fuel to fuel rail 18 under relatively high pressure, for example, above about 14 MPa and even reaching 35 MPa or higher. Each fuel injector 20 receives fuel from fuel rail 18 and injects the fuel into a respective combustion chamber 22 of internal combustion engine 12 for combustion of the fuel within combustion chambers 22.

Figure 4:
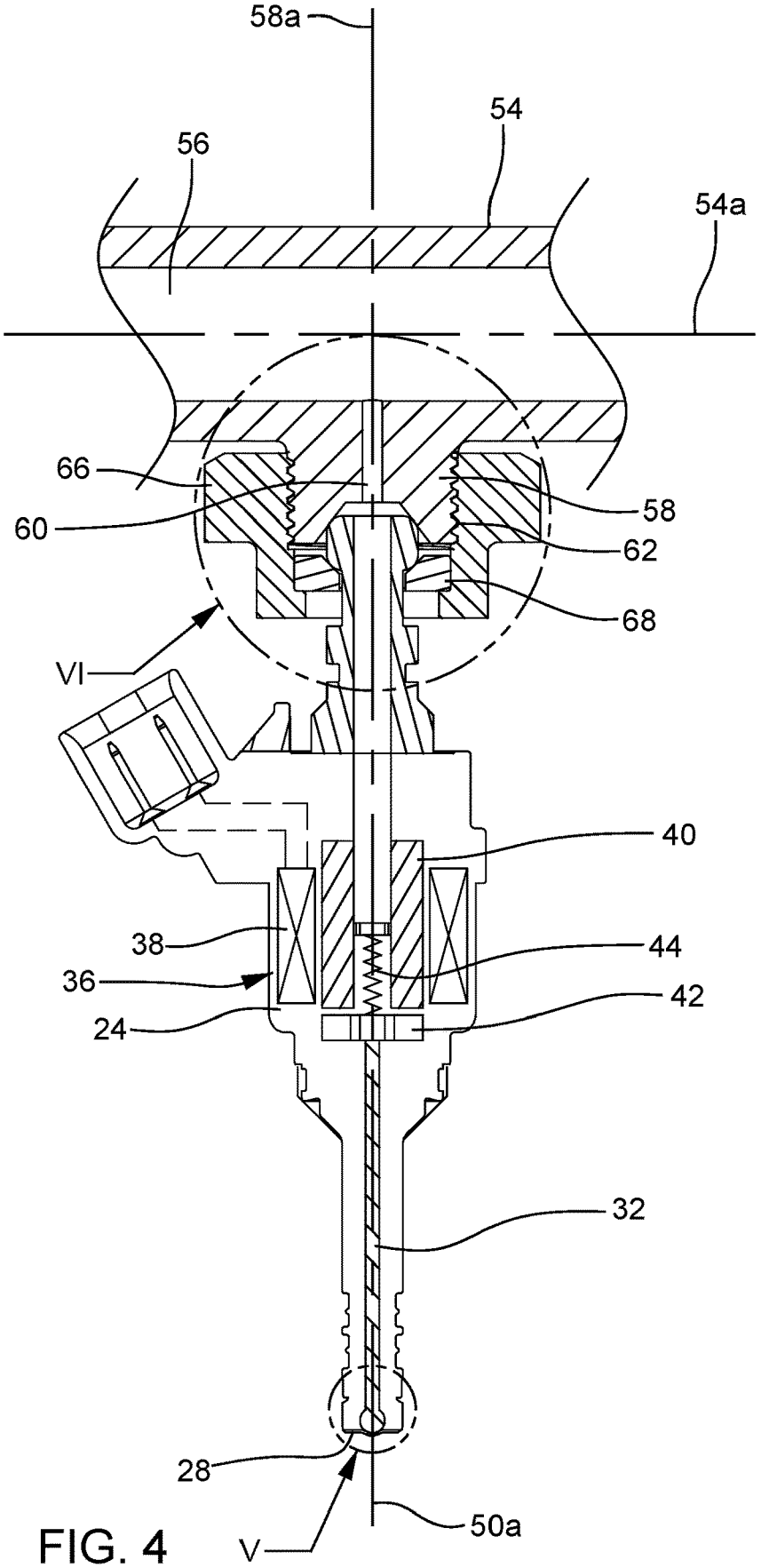
FIG. 4 is an axial cross-sectional view of the fuel rail, fuel injector, and arrangement which secures the fuel injector to the fuel rail.
Figure 5:
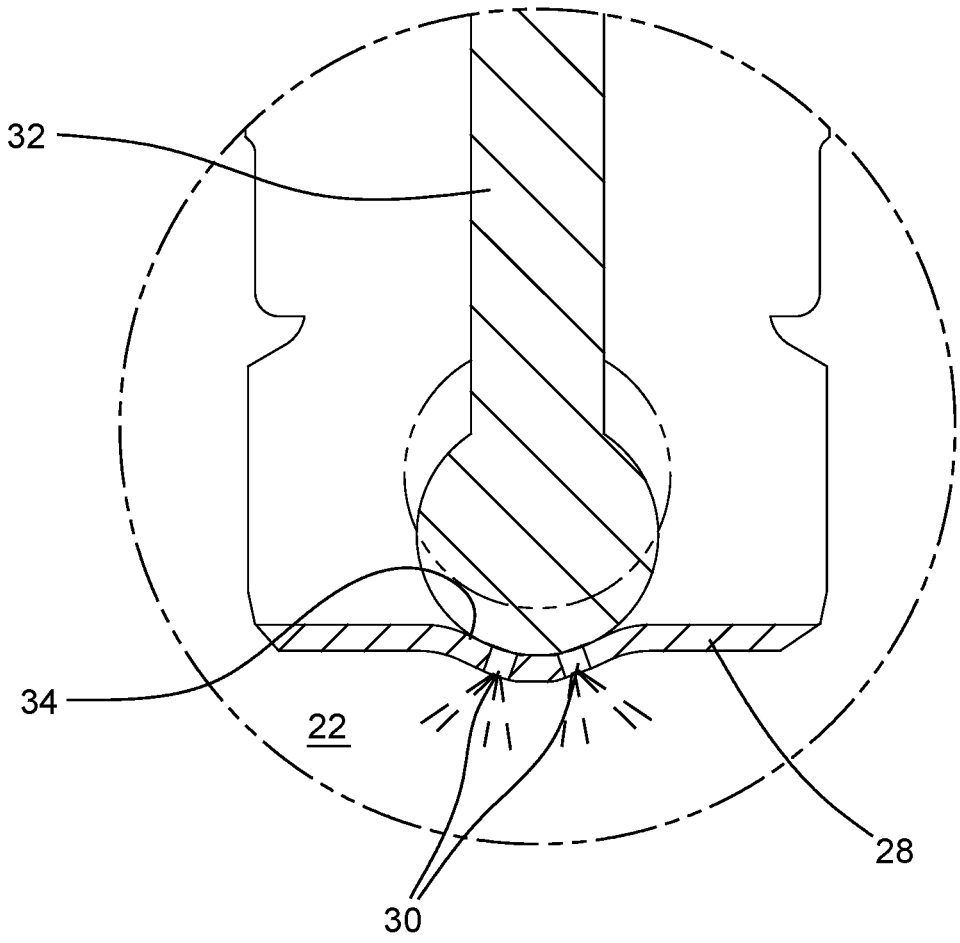
FIG. 5 is an enlarged view of circle V of FIG. 4.

Referring now to FIGS. 4 and 5, fuel injector 20, the internal workings of which are shown in schematic form only in FIG. 4, includes a fuel injector body 24 which is configured to be inserted into a fuel injector receiving bore of a cylinder head 26 of internal combustion engine 12 such that a nozzle tip 28 of fuel injector body 24 communicates with combustion chamber 22 and includes one or more nozzle openings 30 therein from which fuel is selectively discharged from fuel injector 20 into combustion chamber 22. The discharge of fuel from nozzle openings 30 is controlled by a valve needle 32 located within fuel injector body 24 where valve needle 32 is selectively seated with a valve seat 34 (valve needle 32 being shown in solid lines in FIG. 5) to stop discharge of fuel through nozzle openings 30 and is selectively unseated with valve seat 34 (valve needle 32 being shown in phantom lines in FIG. 5) to discharge fuel from fuel injector 20 into combustion chamber 22. Movement of valve needle 32 is controlled by an actuator 36, illustrated herein as a solenoid actuator. As embodied herein, actuator 36 includes a wire winding 38, a pole piece 40 which is stationary, an armature 42 which is moveable with valve needle 32, and a return spring 44 which urges valve needle 32 in a direction to be seated with valve seat 34. When wire winding 38 is energized with an electric current, armature 42 is magnetically attracted to pole piece 40, thereby unseating valve needle 32 from valve seat 34. Conversely, when the electric current to wire winding 38 is stopped, the magnetic attraction between armature 42 and pole piece 40 is stopped, thereby allowing return spring 44 to move valve needle 32 to be seated with valve seat 34. While actuator 36 has been illustrated herein as a solenoid actuator, it should be understood that actuator 36 may take other forms, which may be, by way of non-limiting example only, a piezoelectric actuator. Furthermore, while actuator 36 has been illustrated as directly actuating valve needle 32, it should be understood that actuator 36 may be indirectly acting such that the actuator may be used to control fuel pressure in a control chamber such that the fuel pressure in the control chamber affects the position of valve needle 32. Fuel injector 20 includes a fuel injector inlet conduit 50 which receives fuel from fuel rail 18 for selective injection into combustion chamber 22 such that fuel injector inlet conduit 50 is configured to sealingly mate with fuel rail 18 as will be described in greater detail later. Fuel injector inlet conduit 50 is made of a metal material, and may preferably be stainless steel in order to minimize or prevent corrosion due to contact with corrosive fuels such as gasoline.

Now with reference to FIGS. 2-10, fuel rail 18 includes a fuel rail main conduit 54 which extends along a fuel rail main conduit axis 54*a*. Fuel rail main conduit 54 is tubular, thereby defining a main fuel passage 56 therein which receives high-pressure fuel from high-pressure fuel pump 17. Fuel rail 18 also includes a plurality of fuel distribution conduits 58, one for each fuel injector 20, extending away from fuel rail main conduit 54. Each fuel distribution conduit 58 is substantially identical, and consequently, fuel distribution conduit 58 and respective elements interfacing therewith for making connection to a respective fuel injector 20 will be referred to in singular form with the understanding that the description applies equally to the connections to each fuel injector 20. Fuel distribution conduit 58 extends away from fuel rail main conduit 54 along a fuel distribution conduit axis 58*a* which is preferably perpendicular to fuel rail main conduit axis 54*a*. Fuel distribution conduit axis 58*a* for each fuel distribution conduit 58 is preferably parallel to every other fuel distribution conduit axis 58*a* of every other fuel distribution conduit 58 of fuel rail 18. Fuel distribution conduit 58 includes a distribution passage 60 extending therethrough which is in fluid communication with main fuel passage 56 and is also in fluid communication with fuel injector inlet conduit 50. In this way, fuel is communicated from main fuel passage 56 to fuel injector inlet conduit 50 via distribution passage 60 for injection of fuel into combustion chamber 22. Fuel rail 18 (including fuel rail main conduit 54 and fuel distribution conduit 58) is made of a metal material, and may preferably be stainless steel in order to minimize or prevent corrosion due to contact with corrosive fuels such as gasoline.

An outer periphery of fuel distribution conduit 58 includes external threads 62 thereon. Furthermore, fuel distribution conduit 58 includes a fuel distribution conduit sealing surface 64 which mates with fuel injector inlet conduit 50 to provide a fuel-tight seal therebetween which prevents fuel leakage as will be described in greater detail later. As illustrated herein, fuel distribution conduit sealing surface 64 may be frustoconical in shape and concave in nature, however, may alternatively be other shapes such as frustospherical or convex in nature.

Fuel injector inlet conduit 50 is tubular and extends along a fuel injector inlet conduit axis 50*a* which is nominally coincident with fuel distribution conduit axis 58*a* and is shown as such in the figures, however, some angular or lateral misalignment may be accommodated by the connection arrangement used to connect fuel injector inlet conduit 50 to fuel distribution conduit 58. Fuel injector inlet conduit 50 extends along fuel injector inlet conduit axis 50*a* from a first end 50*b* which is most-distal from nozzle openings 30, i.e. first end 50*b* is the furthest-most portion of fuel injector inlet conduit 50 from nozzle openings 30. Fuel injector inlet conduit 50 includes a fuel injector inlet conduit shoulder 50*c* which is traverse to fuel injector inlet conduit axis 50*a* and faces in a direction away from first end 50*b*. Fuel injector inlet conduit shoulder 50*c* is formed by an area of reduced diameter which is spaced axially away from first end 50*b*. Furthermore, fuel injector inlet conduit shoulder 50*c* may be radiused as shown at its radially outward extent. Fuel injector inlet conduit 50 also includes a fuel injector inlet conduit sealing surface 50*d* which mates with fuel distribution conduit sealing surface 64. As illustrated herein, fuel injector inlet conduit sealing surface 50*d* is a radiused corner initiating at first end 50*b*, however, fuel injector inlet conduit sealing surface 50*d* may be any shape which complements fuel distribution conduit sealing surface 64 to mate in a fluid-tight interface and allows angular misalignment between fuel injector 20 and fuel distribution conduit 58.

In order to sealingly compress together fuel injector inlet conduit sealing surface 50*d* and fuel distribution conduit sealing surface 64, fuel system 10 includes a connection nut 66 and a retention member 68. In the paragraphs that follow, the features of connection nut 66 and retention member 68 will be described in greater detail.

Connection nut 66 is made of a metal material and includes a connection nut upper portion 66*a* which circumferentially surrounds fuel distribution conduit 58 and a connection nut lower portion 66*b* which circumferentially surrounds fuel injector inlet conduit 50 such that connection nut 66 extends from a connection nut upper end 66*c* which is distal from nozzle openings 30 to a connection nut lower end 66*d* which is proximal to nozzle openings 30. Connection nut 66 includes a connection nut central passage 66*e* extending axially therethrough from connection nut upper end 66*c* to connection nut lower end 66*d*. Connection nut 66 includes internal threads 66*f* within connection nut central passage 66*e* such that internal threads 66*f* are located within connection nut upper portion 66*a*. Internal threads 66*f* are complementary to, and are threadably engaged with, external threads 62 of fuel distribution conduit 58. It should be noted that the smallest portion of connection nut central passage 66*e* in the radial direction, i.e. the portion of connection nut central passage 66*e* which is proximal to connection nut lower end 66*d*, is sized to allow fuel injector inlet conduit 50 to be inserted thereinto at least until fuel injector inlet conduit shoulder 50*c* is located therein. It should also be noted that prior to connection nut 66 being tightened, connection nut central passage 66*e* is sized to allow angular misalignment between fuel injector 20 and fuel distribution conduit 58 which may exist during mounting of fuel rail 18 to cylinder head 26.

After internal threads 66*f*, connection nut central passage 66*e* includes a connection nut internal shoulder 66*g* which is traverse to fuel distribution conduit axis 58*a*. As illustrated herein connection nut internal shoulder 66*g* may be perpendicular to fuel distribution conduit axis 58*a*, however, may alternatively be inclined relative to fuel distribution conduit axis 58*a*. As can be seen in figures, connection nut internal shoulder 66*g* is formed by the stepped-nature of connection nut central passage 66*e*, i.e. connection nut central passage 66*e* is larger in diameter above connection nut internal shoulder 66*g* and smaller in diameter below connection nut internal shoulder 66*g*.

Figure 3:
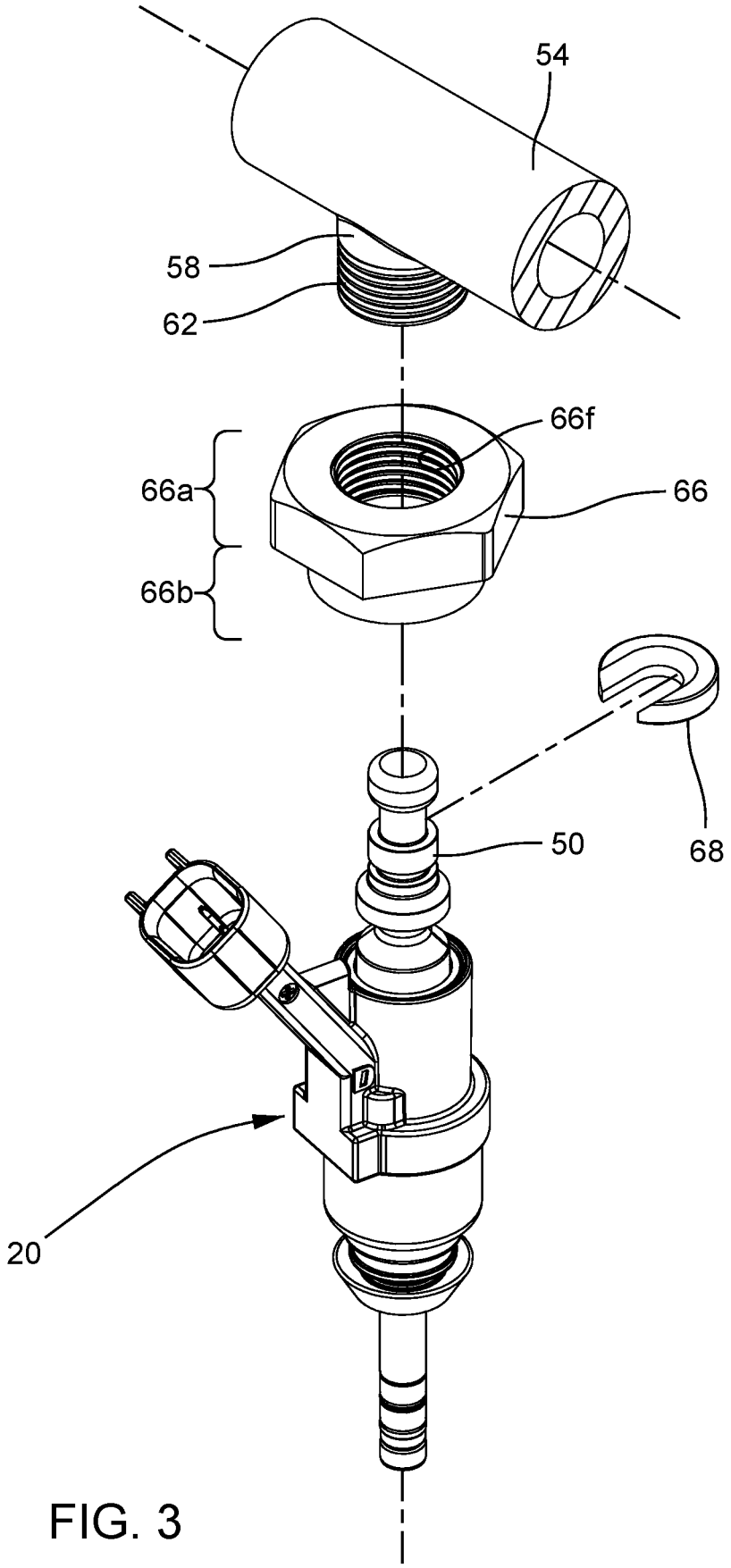
FIG. 3 is an exploded isometric view of the fuel rail, fuel injector, and an arrangement which secures the fuel injector to the fuel rail.
Figure 10:
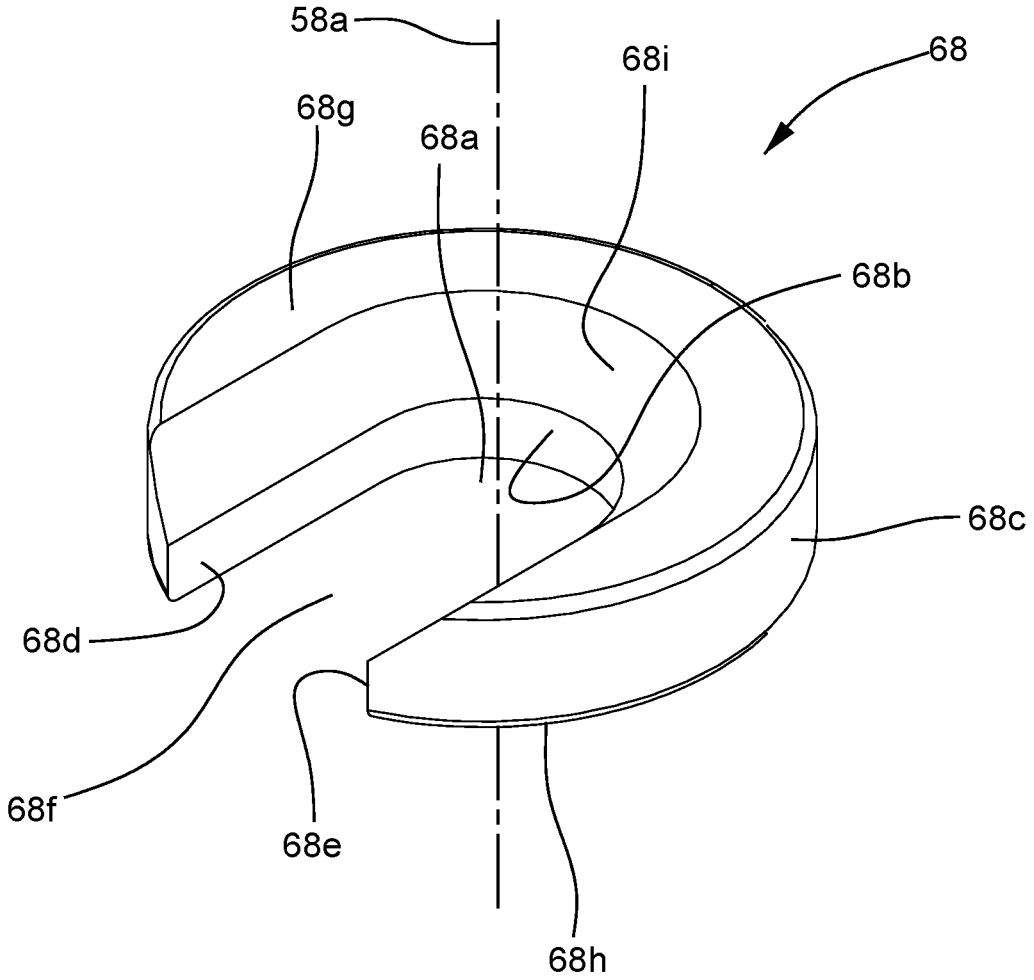
FIG. 10 is an enlarged isometric view of a retention member of FIG. 3.

As may be most apparent from FIGS. 3 and 10, retention member 68 is a segment of an annulus having a retention member central passage 68*a* extending axially therethrough. As a result of retention member 68 being a segment of an annulus, retention member 68 includes a retention member inner peripheral surface 68*b* and a retention member outer peripheral surface 68*c*. Retention member 68 is preferably made of a metal material, but may alternatively be made of a polymer such as nylon. As illustrated in the figures, retention member inner peripheral surface 68*b* and retention member outer peripheral surface 68*c* may each be circular in shape in a direction perpendicular to fuel distribution conduit axis 58*a* such that retention member inner peripheral surface 68*b* and retention member outer peripheral surface 68*c* are each centered about fuel distribution conduit axis 58*a*. As used herein with respect to retention member inner peripheral surface 68*b* and retention member outer peripheral surface 68*c*, circular is not a full circle, but rather a portion of a circle having a constant radius. Also as illustrated in the figures, retention member inner peripheral surface 68*b* and retention member outer peripheral surface 68*c* may each be parallel to fuel distribution conduit axis 58*a*. Retention member 68 is terminated in a direction circumferentially about fuel distribution conduit axis 58*a* by a retention member first end surface 68*d* and by a retention member second end surface 68*e* which together form a retention member slot 68*f* therebetween which extends from retention member outer peripheral surface 68*c* to retention member inner peripheral surface 68*b*. Retention member slot 68*f* is sized so as to permit the portion of fuel injector inlet conduit 50 that is below fuel injector inlet conduit shoulder 50*c* to pass through retention member slot 68*f* in a direction perpendicular to fuel distribution conduit axis 58*a*. As shown in the figures, retention member first end surface 68*d* and retention member second end surface 68*e* may each be planar and parallel to each other such that retention member first end surface 68*d* faces toward retention member second end surface 68*e*. Also as shown in the figures, retention member first end surface 68*d* and retention member second end surface 68*e* may be spaced to be tangential to retention member inner peripheral surface 68*b*, however, it should be understood that retention member first end surface 68*d* and retention member second end surface 68*e* need only be spaced apart from each other to an extent which allows fuel injector inlet conduit 50 to pass therebetween to be positioned within retention member central passage 68*a*.

Retention member 68 extends axially from a retention member upper end surface 68*g*, which is proximal to fuel rail main conduit 54, to a retention member lower end surface 68*h* which is distal from fuel rail main conduit 54. As illustrated in the figures, retention member upper end surface 68*g* may be perpendicular to fuel distribution conduit axis 58*a*. Similarly, retention member lower end surface 68*h* may be perpendicular to fuel distribution conduit axis 58*a* in order to be complementary to connection nut internal shoulder 66*g*, however, is preferably formed to match the angle of connection nut internal shoulder 66*g* if connection nut internal shoulder 66*g* is not perpendicular to fuel distribution conduit axis 58*a*. Retention member 68 includes a retention member mating surface 68*i* which extends from retention member inner peripheral surface 68*b* to retention member upper end surface 68*g*. Retention member mating surface 68*i* is traverse to fuel distribution conduit axis 58*a* and may have a shape which is complementary to fuel injector inlet conduit shoulder 50*c*, for example, a segment of a conical frustum or a segment of a spherical frustum, thereby providing for retention of fuel injector 20 while allowing for angular misalignment between fuel injector 20 and fuel distribution conduit 58. Accommodation of angular misalignment between fuel injector 20 and fuel distribution conduit 58 is also provided by retention member central passage 68*a* being sized sufficiently large to accommodate this misalignment. As can be seen in the figures, retention member mating surface 68*i* is inclined relative to both retention member inner peripheral surface 68*b* and retention member upper end surface 68*g*.

Figure 6:
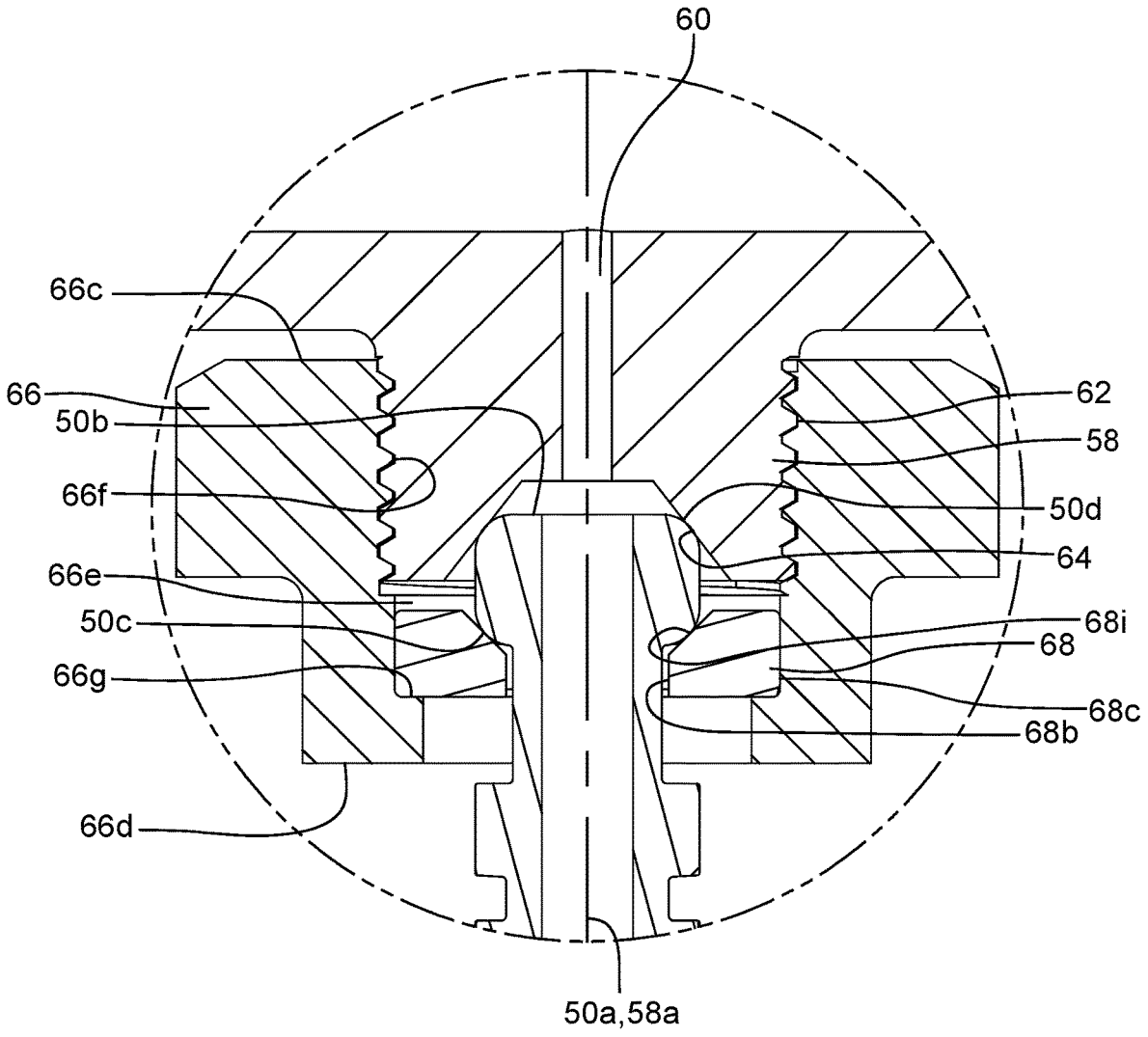
FIG. 6 is an enlarged view of circle VI of FIG. 4.
Figure 7:
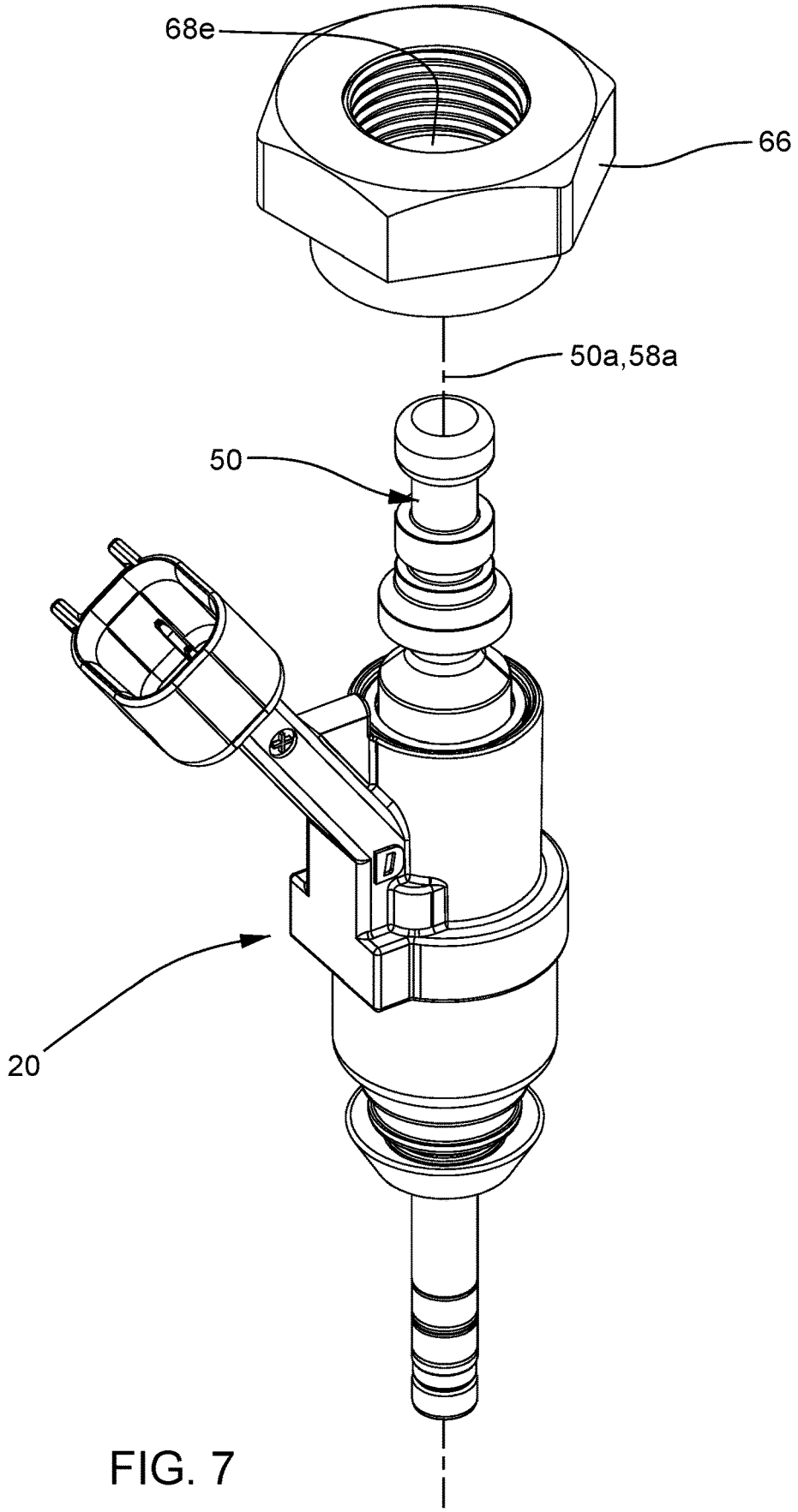
FIGS. 7-9 show a progression of steps of assembly.
Figure 8:
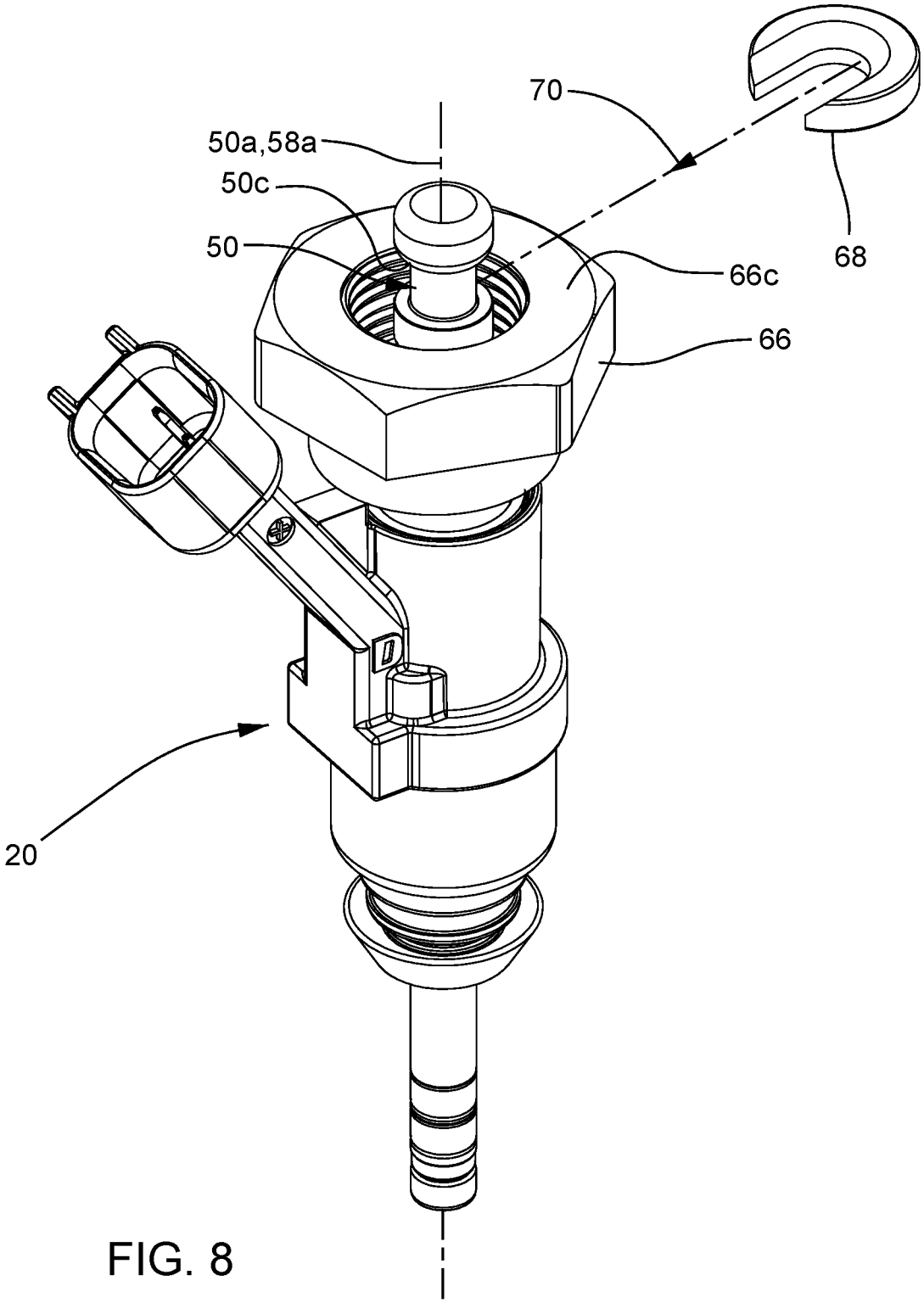
Figure 9:
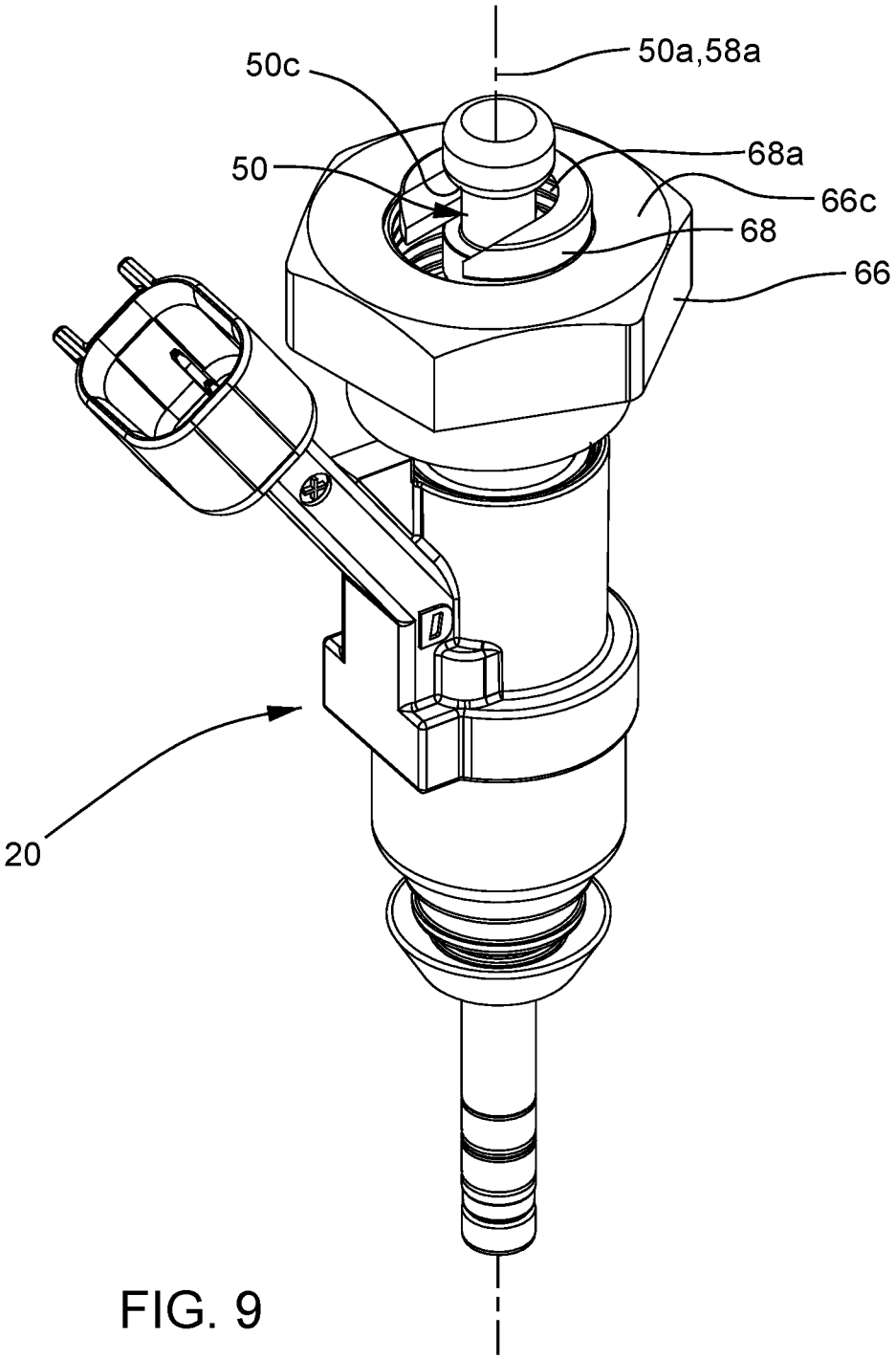

Assembly of fuel injector 20 to fuel rail 18 will now be described. In a first step as shown in FIGS. 7 and 8, fuel injector inlet conduit 50 is inserted into connection nut central passage 66*e* along fuel injector inlet conduit axis 50*a*/fuel distribution conduit axis 58*a* to a further extent than is necessary after connection nut 66 is tightened. Next, retention member 68 is assembled to fuel injector inlet conduit 50 by translating retention member 68 laterally, preferably perpendicular, relative to fuel injector inlet conduit axis 50*a* in a direction indicated by arrow 70 in FIG. 8. As retention member 68 is moved in the direction of arrow 70, the portion of fuel injector inlet conduit 50 which is axially between fuel injector inlet conduit shoulder 50*c* and connection nut upper end 60*c* is received within retention member 68 until fuel injector inlet conduit 50 is received within retention member central passage 68*a* as shown in FIG. 9. Next, connection nut 66 is threaded onto fuel distribution conduit 58 and is tightened, as shown in FIG. 6, thereby resulting in retention member 68 contacting fuel injector inlet conduit shoulder 50*c* and also thereby resulting in fuel distribution conduit sealing surface 64 contacting fuel injector inlet conduit sealing surface 50*d*. As a result, retention member 68 is compressed between fuel injector inlet conduit shoulder 50*c* and connection nut internal shoulder 66*g*. This compression of retention member 68 causes fuel distribution conduit sealing surface 64 and fuel injector inlet conduit sealing surface 50*d* to be sealingly compressed against each other to form an interface such that fuel passing from fuel distribution conduit 58 to fuel injector inlet conduit 50 does not leak past the interface, i.e. the fuel cannot leak to the environment and the fuel is contained within fuel distribution conduit 58 and fuel injector inlet conduit 50 until being deliberately released from fuel injector 20 through nozzle openings 30.

While fuel distribution conduit 58 has been embodied herein as being an integral and unitary element with fuel rail 18, it should be understood that fuel distribution conduit 58 may alternatively be a pipe that is formed independent of fuel rail 18 and sealed thereto. In a further alternative, fuel distribution conduit 58 may be a supply conduit which is not connected to a fuel rail, but rather receives fuel directly from a fuel pump.

Use of connection nut 66 and retention member 68 as disclosed herein to connect fuel injector 20 to fuel rail 18 provides for robust sealing at ever-increasing pressures while providing simple construction. This arrangement may also allow for minimal design change to existing fuel injector designs, which had previously used convention elastomer O-rings to achieve sealing, to be changed to a metal-to-metal sealing interface. Such design change may be limited to altering the outer profile of fuel injector inlet conduit 50. Consequently, minimal manufacturing equipment change may be required to change the fuel injector design to accommodate a metal-to-metal sealing interface.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

I claim:

1. A fuel system for supplying fuel to a fuel consuming device, said fuel system comprising:

a fuel injector having a fuel injector inlet conduit, a nozzle opening, and a valve needle which is moveable to selectively permit and prevent flow of fuel from said fuel injector inlet conduit through said nozzle opening, said fuel injector inlet conduit extending along a fuel injector inlet conduit axis and said fuel injector inlet conduit having a fuel injector inlet conduit shoulder which is traverse to said fuel injector inlet conduit axis;

a fuel distribution conduit which supplies fuel to said fuel injector, said fuel distribution conduit extending along a fuel distribution conduit axis and having external threads thereon;

a connection nut having internal threads which are complementary to, and threadably engaged with, said external threads of said fuel distribution conduit, said connection nut also having a connection nut internal shoulder which is traverse to said fuel distribution conduit axis; and a retention member which is a segment of an annulus and which includes a retention member central passage extending axially therethrough, said retention member being terminated in a direction circumferentially about said fuel distribution conduit axis by a retention member first end surface and by a retention member second end surface which together form a retention member slot therebetween which is sized so as to permit said fuel injector inlet conduit to pass therethrough in a direction perpendicular to said fuel distribution conduit axis, and wherein said retention member engages said fuel injector inlet conduit shoulder and said connection nut internal shoulder such that tightening of said connection nut causes said retention member to be compressed between said fuel injector inlet conduit shoulder and said connection nut internal shoulder.

2. A fuel system as in claim 1, wherein said retention member first end surface and said retention member second end surface are parallel to each other.

3. A fuel system as in claim 1, wherein said retention member slot extends from a retention member outer peripheral surface of said retention member to a retention member inner peripheral surface of said retention member.

4. A fuel system as in claim 3, wherein said retention member inner peripheral surface is circular in shape in a direction perpendicular to said fuel distribution conduit axis.

5. A fuel system as in claim 4, wherein said retention member outer peripheral surface is centered about said fuel distribution conduit axis.

6. A fuel system as in claim 4, wherein said retention member outer peripheral surface is circular in shape in a direction perpendicular to said fuel distribution conduit axis.

7. A fuel system as in claim 6, wherein said retention member outer peripheral surface is centered about said fuel distribution conduit axis.

8. A fuel system as in claim 1, wherein said retention member extends axially from a retention member upper end surface to a retention member lower end surface and said retention member includes a retention member mating surface which engages said fuel injector inlet conduit shoulder and which is inclined to both said retention member upper end surface and to a retention member inner peripheral surface of said retention member.

9. A fuel system as in claim 8, wherein said retention member inner peripheral surface is parallel to said fuel distribution conduit axis.

10. A fuel system as in claim 8, wherein said retention member mating surface is complementary to said fuel injector inlet conduit shoulder such that angular misalignment between said fuel injector inlet conduit and said fuel distribution conduit is accommodated while retaining said fuel injector.

11. A fuel system as in claim 10, wherein said retention member mating surface is a segment of a frustum.

12. A fuel system as in claim 1, wherein said connection nut includes a connection nut central passage extending axially therethrough such that said connection nut central passage is sized to accommodate angular misalignment between said fuel injector inlet conduit and said fuel distribution conduit.

13. A fuel system as in claim 1, wherein:

said fuel injector inlet conduit includes a fuel injector inlet conduit sealing surface;

said fuel distribution conduit includes a fuel distribution conduit sealing surface; and compression of said retention member between said fuel injector inlet conduit shoulder and said connection nut internal shoulder causes said fuel injector inlet conduit sealing surface and said fuel distribution conduit sealing surface to be sealingly compressed against each other to form an interface such that fuel passing from said fuel distribution conduit to said fuel injector inlet conduit does not leak past said interface.

14. A fuel system as in claim 1, wherein said retention member central passage is sized so as to allow angular misalignment between said fuel injector and said fuel distribution conduit.

15. A fuel system for supplying fuel to a fuel consuming device, said fuel system comprising:

a fuel injector having a fuel injector inlet conduit, a nozzle opening, and a valve needle which is moveable to selectively permit and prevent flow of fuel from said fuel injector inlet conduit through said nozzle opening, said fuel injector inlet conduit extending along a fuel injector inlet conduit axis and said fuel injector inlet conduit having a fuel injector inlet conduit shoulder;

a fuel distribution conduit which supplies fuel to said fuel injector, said fuel distribution conduit extending along a fuel distribution conduit axis and having external threads thereon;

a connection nut having internal threads which are complementary to, and threadably engaged with, said external threads of said fuel distribution conduit, said connection nut also having a connection nut internal shoulder; and a retention member which is a segment of an annulus and which includes a retention member central passage extending axially therethrough, said retention member being terminated in a direction circumferentially about said fuel distribution conduit axis by a retention member first end surface and by a retention member second end surface which together form a retention member slot therebetween which is sized so as to permit said fuel injector inlet conduit to pass therethrough in a direction perpendicular to said fuel distribution conduit axis, and wherein said retention member engages said fuel injector inlet conduit shoulder and said connection nut internal shoulder such that tightening of said connection nut causes said retention member to be compressed between said fuel injector inlet conduit shoulder and said connection nut internal shoulder.

* * * * *